US006114002A

United States Patent [19]

Rinaldo

[11] Patent Number: 6,114,002

[45] Date of Patent: Sep. 5, 2000

[54] PORTABLE HYGIENIC MAT

[75] Inventor: Burgassi Rinaldo, Lorenzana, Italy

[73] Assignees: Roberto Risaliti; Patrizio Innocenti, both of Prato, Italy

[21] Appl. No.: 09/043,611

[22] PCT Filed: Nov. 27, 1995

[86] PCT No.: PCT/IT95/00198

§ 371 Date: May 26, 1998

§ 102(e) Date: May 26, 1998

[87] PCT Pub. No.: WO97/19623

PCT Pub. Date: Jun. 5, 1997

[51] Int. Cl.[7] ..... B32B 3/00

[52] U.S. Cl. ..... 428/68; 4/581; 15/215; 15/216; 428/44; 428/45; 428/52; 428/121; 428/192

[58] Field of Search ..... 428/68, 44, 45, 428/52, 192, 121; 4/581; 15/215, 216

[56] References Cited

U.S. PATENT DOCUMENTS 4,940,620 7/1990 Silk ..... 428/81

5,173,346 12/1992 Middleton ..... 428/53

*Primary Examiner*—Nasser Ahmad

*Attorney, Agent, or Firm*—Simpson, Simpson & Snyder, L.L.P.

[57] ABSTRACT

Hygienic mat which can be used standing steadily on it to wipe the feet after a shower or a bath and which at the same time can be folded, as well as being light and portable. Its characteristic is to comprise a first and a second pad (2*a*, 2*b*) hinged on adjacent borders (3) in a folding relationship between an open flat position and a closed book-like position. Each pad (2*a*, 2*b*) preferably engages with a flat stiff support (4*a*, 4*b*) in a recesses (5*a*, 5*b*) defined by a boundary rim (6) raised from a stiff bottom (4). Preferably, the pads (2*a*, 2*b*) have a permeable spongy towel-like absorbing cloth (9) attached to a resilient base sheet (10) and are hinged by means of either a a flexible strip (7) or a plurality of joints (8). Gripping means (13) fixed to the boundary of said pads or supports are advantageously provided for.

8 Claims, 2 Drawing Sheets

Fig. 1
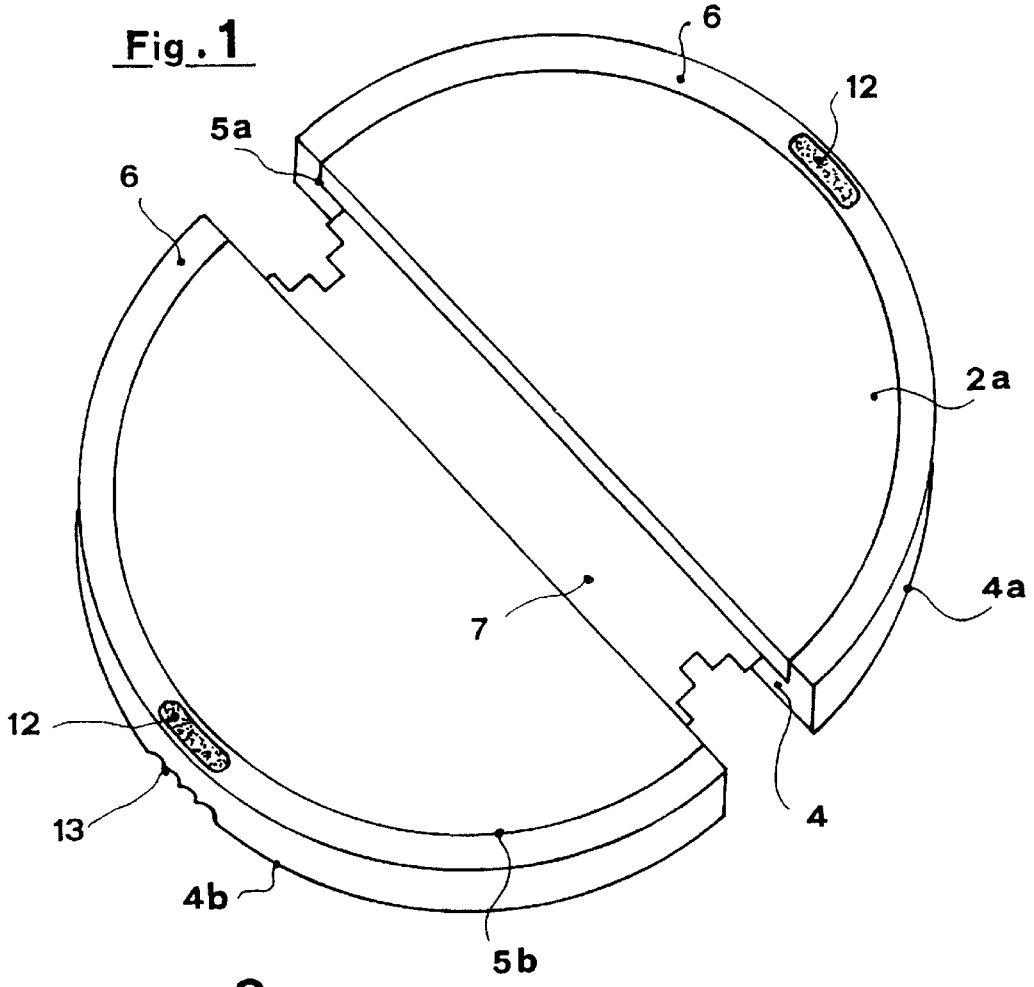
Fig. 2
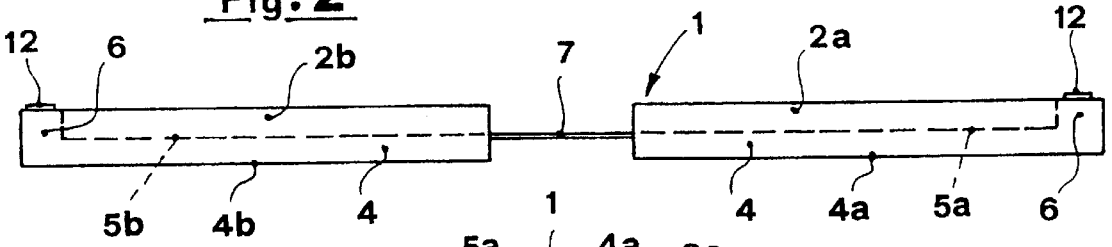
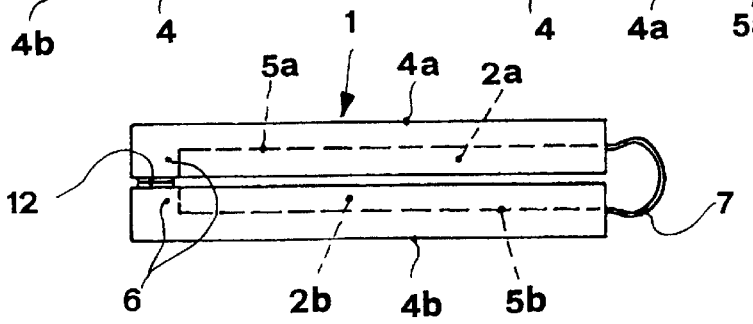
Fig. 3

PORTABLE HYGIENIC MAT

DESCRIPTION

1. Field of the Invention

The present invention relates to an article which can be used after having taken a shower or a bath and more precisely it relates to a portable hygienic mat.

2. Description of the Prior Art

After a shower or a bath normally people need to wipe their feet before dressing. This operation, which is not problematic at home or in a hotel where clean shower mats are available, is often not very comfortable in public places, such as gymnasiums, where people are forced to put their feet inside wet sandals or even on a dirty floor.

In fact, while taking a shower people normally stand up wearing sandals on their feet to prevent direct contact with a dirty wet floor where fungi or other diseases may be present. After the shower has been completed and after having reached the place where they wipe themselves and get dressed, people need a dry and hygienic place where to stand while wiping their feet.

Where available, such place could be a bench or a rug on which, nevertheless, fungi or other diseases can also be present. In addition, however, while getting dressed people cannot often avoid in some measure to put the feet on the dirty floor or inside the wet slippers again.

SUMMARY OF THE INVENTION

The object of the present invention is to provide a hygienic mat which can be used standing steadily on it after having taken a shower or a bath to wipe the feet and which at the same time can be folded, as well as being light and portable.

This object is accomplished by the hygienic mat according to the present invention, whose characteristic is to comprise a first and a second pad hinged on adjacent borders in a folding relationship between an open flat position and a closed book-like position.

Each pad preferably engages with a flat stiff support so that the pads are hinged to each other via the supports, in said closed position said pads facing each other. The pads can be inserted in a separable way in recesses provided for in said supports and defined by a boundary rim raised from a stiff bottom. Alternatively, the pads are fixed to the supports through revertible fastening means.

The pads preferably have a permeable spongy towel-like absorbing cloth attached to a resilient base sheet.

The pads or the supports holding the pads are hinged by means of either a flexible strip or a plurality of joints having two halves fixed respectively to each pad or support on said adjacent borders. Gripping means fixed to the boundary of said pads or supports are advantageously provided for.

BRIEF DESCRIPTION OF THE DRAWINGS

The invention will be illustrated with the following description of two of its possible embodiments, given as an example and not limitative, with reference to the attached drawings in which:

FIGS. 1 and 2 are respectively a perspective and a side sectional view of a hygienic mat according to the present invention;

FIG. 3 shows the hygienic mat of FIGS. 1 and 2 in a closed book-like position;

DESCRIPTION OF THE PREFERRED EMBODIMENTS

Figure 4:
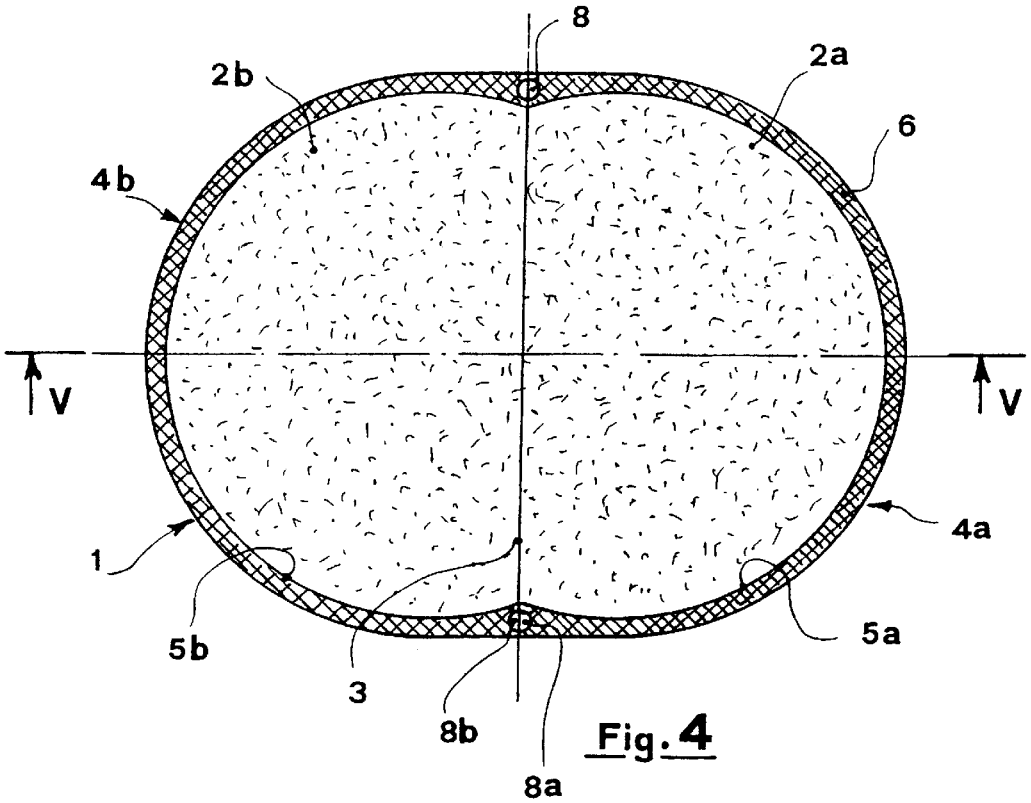
FIG. 4 and 5 are respectively a top plan view and a side sectional view of a different embodiment of the hygienic mat according to the present invention.

With reference to FIGS. 1, 2 and 3, a hygienic mat 1 according to the present invention comprises a first and a second pad 2*a* and 2*b* hinged on adjacent borders 3 in a folding relationship between an open flat position (FIGS. 1 and 2) and a closed book-like position (FIG. 3).

Pads 2*a* and 2*b* engage with flat stiff supports 4*a* and 4*b* for example half-moon shaped sheets made of moulded plastic. More precisely supports 4*a* and 4*b* have recesses 5*a* and 5*b* defined by boundary rims 6 raised from a stiff bottom 4 and in which pads 2*a* and 2*b* are inserted. Pads 2*a* and 2*b* are hinged to each other via the supports 4*a* and 4*b* by way of a flexible strip 7, which can be made of leather or plastics.

Alternatively, according to a different embodiment of the invention (see FIG. 4), supports 4*a* and 4*b* are hinged on each other by means of joints 8 made of two halves, 8*a* and 8*b* fixed respectively to supports 4*a* and 4*b* and pivotally or flexibly connected.

Figure 5:
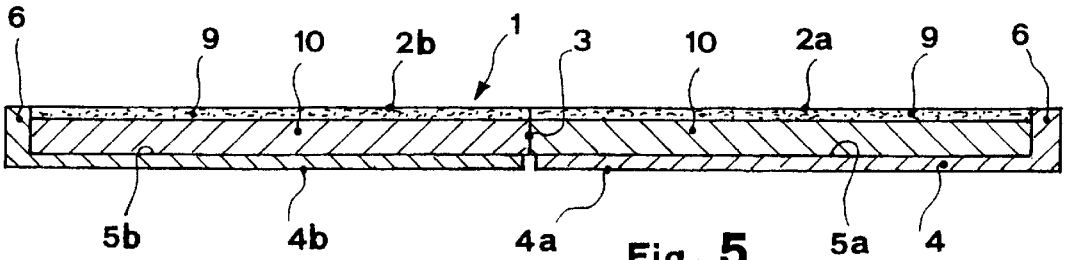

Pads 2*a* and 2*b* can be made of a towel-like absorbing spongy cloth 9, suitable for wiping feet. Preferably, as shown in FIG. 5, pads 2*a* and 2*b* comprise a bottom resilient sheet 10, for example made of polyurethane foam, on which cloth 9 is attached. Absorbent cloth 9 can be thicker or thinner than resilient sheet 10, according to the desired soaking capability.

In the open position (FIGS. 1, 2 and 4, 5) pads 2*a* and 2*b* form a flat hygienic surface on which a person can steadily stand and at the same time can wipe the feet.

Figure 6:
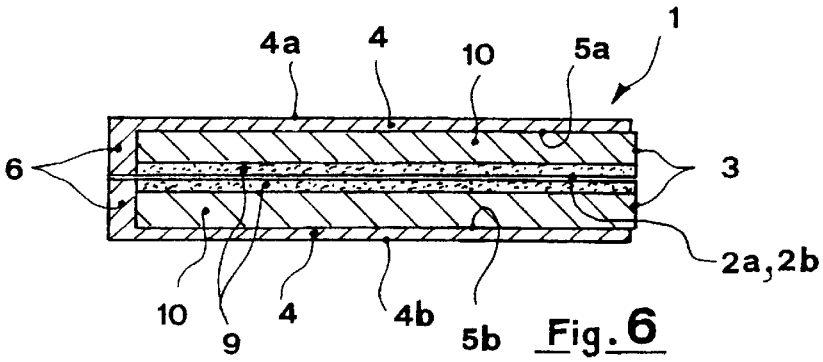
FIG. 6 shows the hygienic mat of FIGS. 4 and 5 in a closed book-like position.

In the closed position (FIGS. 3 and 6) pads 2*a* and 2*b* face each other and supports 4*a* and 4*b* are held together by fastening means such as straps 12, shown also in FIG. 1.

The book-like shape of hygienic mat 1 when closed is particularly functional because it has small dimensions, and at the same time it is lightweight and externally dry even if wet inside. For this reason it is particularly suitable for being carried in a bag together with sport clothes, shoes, towels.

The shape of pads 2*a* and 2*b* may be whichever, for example circular as shown in the attached drawings, or rectangular, elliptical, feet-like, etc.

Pads 2*a* and 2*b* are inserted in recesses 5*a* and 5*b* in a separable way so that they can be removed and washed when dirty. According to a different embodiment (not shown), supports 4*a* and 4*b* are flat bases without boundary rims and pads 2*a* and 2*b* are fixed to them through revertible fastening means, such as straps, press studs, zippers and other equivalent known means.

Gripping means of a known type can be provided for on the boundary of said pads or supports so that the hygienic mat according to the invention is easily carried by the users. As shown in FIG. 1 an anatomic boundary grip portion 13 is provided on supports 4*a* and 4*b* to improve the grip of the users. Alternatively, handles which have not been illustrated may be provided for.

The invention is not limited to the embodiment described and illustrated above, but comprises any and all variations of execution.

What is claimed is:

1. A portable hygienic mat, comprising:

a first and second pad;

a first and second flat stiff support, each of said supports having a recess therein operatively arranged to temporarily hold said first and second pads, respectively;

wherein each said recess is formed by a stiff, inflexible rim projecting upwardly from said support about the boundary thereof;

said first and second pads hinged to one another along an adjacent border;

said first and second supports hinged to one another along said adjacent border;

wherein said first and second supports are operatively arranged to be folded into one another along said hinged adjacent border such that said first and second pads face each other;

wherein said first and second pads are detachably secured within said first and second support recesses, respectively.

2. A hygienic mat according to claim 1, wherein said pads (2*a*, 2*b*) are fixed in said recesses (5*a*, 5*b*) provided for in said supports (4*a*, 4*b*) in a separable way through revertible fastening means (12).

3. A hygienic mat according to claim 2, wherein either said pads or said supports are hinged by means of a flexible strip (7) whose opposite longitudinal margins are fixed to said adjacent borders (3) of said pads (2*a*, 2*b*) or supports (4*a*, 4*b*).

4. A hygienic mat according to claim 3, wherein said pads (2*a*, 2*b*) or supports (4*a*, 4b) are hinged by means of a plurality of joints (8) having two halves (8*a*, 8*b*) fixed respectively to each pad (2*a*, 2*b*) or support (4*a*, 4*b*) on said adjacent borders (3).

5. A hygienic mat according to claim 4, wherein said pads have a permeable spongy absorbing cloth (9) attached to a resilient base sheet (10).

6. A hygienic mat according to claim 1, wherein said pads (2*a*, 2*b*) have a waterproof side (10) opposite to a permeable spongy absorbing side (9).

7. A hygienic mat according to claim 1, wherein gripping means (13) fixed to the boundary of said pads (2*a*, 2*b*) or supports (4*a*, 4*b*) are provided for.

8. A hygienic mat according to claim 1, wherein said supports (4*a*, 4*b*) and said pads (2*a*, 2*b*) are half-moon shaped.

* * * * *